US007458598B2

(12) United States Patent
Giffin et al.

(10) Patent No.: US 7,458,598 B2
(45) Date of Patent: Dec. 2, 2008

(54) TELEMARK BINDING WITH RELEASABLE RISER PLATE ASSEMBLY

(76) Inventors: Jeffrey Giffin, 4135 Sunny Hill La., Lummi Island, WA (US) 98262; Lawrence Evan Carlson, 2541 Bluff St., Boulder, CO (US) 80304

( * ) Notice: Subject to any disclaimer, the term of this patent is extended or adjusted under 35 U.S.C. 154(b) by 268 days.

(21) Appl. No.: 11/294,820

(22) Filed: Dec. 5, 2005

(65) Prior Publication Data

US 2007/0126203 A1 Jun. 7, 2007

(51) Int. Cl.
*A63C 7/10* (2006.01)
*A63C 9/086* (2006.01)

(52) U.S. Cl. ..... 280/615; 280/605

(58) Field of Classification Search ..... 280/604, 280/605, 613, 614, 615, 619, 620, 634
See application file for complete search history.

(56) References Cited

U.S. PATENT DOCUMENTS 3,918,732 A * 11/1975 Wulf ..... 280/618
3,951,424 A 4/1976 Näpflin
4,172,602 A 10/1979 Gertsch et al.
4,768,805 A * 9/1988 Graillat ..... 280/615
4,836,572 A * 6/1989 Pozzobon ..... 280/613
4,850,608 A * 7/1989 Flick ..... 280/625
4,928,988 A 5/1990 Hue
5,310,206 A * 5/1994 Eugler et al. ..... 280/615
5,551,721 A * 9/1996 Renaud-Goud et al. ..... 280/605
5,803,480 A 9/1998 Hauglin et al.
5,823,563 A 10/1998 Dubuque
5,893,576 A * 4/1999 Hauglin ..... 280/621
5,957,478 A 9/1999 Vigny
D425,162 S 5/2000 Hauglin
6,092,830 A 7/2000 Wheeler
6,105,994 A 8/2000 Parris et al.
6,202,326 B1 3/2001 Hauglin
6,299,193 B1 10/2001 Parris et al.
6,308,979 B1 * 10/2001 Ludlow ..... 280/615
6,322,095 B1 11/2001 Wheeler
6,409,204 B1 6/2002 Ayliffe
6,623,027 B1 9/2003 Wheeler
6,685,213 B2 2/2004 Hauglin

* cited by examiner

*Primary Examiner*—Frank B Vanaman
(74) *Attorney, Agent, or Firm*—Sheridan Ross P.C.

(57) ABSTRACT

A releasable riser plate assembly is provided for use with a telemark binding. The assembly is mounted to a ski. The assembly includes a base plate interconnecting a front and rear housing, and a release plate mounted over the base plate. Force transmitting members are integrated in the housings to hold the release plate. A toe adapter of the telemark binding is mounted on the release plate. The toe of a ski boot is secured in the toe adapter. Adequate force generated by the boot in either a lateral direction or vertical direction results in disengagement of the release plate from the base plate and housings. Accordingly, the boot separates from the ski. The assembly incorporates a ski brake. The ski brake activates upon separation of the release plate. The release plate is reattached by a step-in motion wherein a front portion of the release plate is positioned under a lip of the front housing, and then the heel of the boot is pressed down against the ski to seat a rear portion of the release plate against the base plate and rear housing.

16 Claims, 5 Drawing Sheets

TELEMARK BINDING WITH RELEASABLE RISER PLATE ASSEMBLY

FIELD OF THE INVENTION

The present invention relates to ski bindings, and more particularly, to a releasable riser plate assembly especially adapted for use with a Telemark ski binding.

BACKGROUND OF THE INVENTION

In the ski industry, the term "Telemark" refers to a type of a ski turn wherein the heels of the ski boots are not attached to the skis while conducting the turn. The Telemark style of skiing essentially disappeared with the advent of alpine skiing equipment. Alpine skiing equipment utilizes ski bindings that lock both the heel and toe of the ski boot on the ski.

Cross-country or touring skis typically include the use of soft ski boots and bindings that allow the heel to freely rotate to and away from the ski, while the toe of the boot remains attached to the ski. This free-heel characteristic of cross-country ski equipment enables the skier to conduct a standard walking motion in order to propel the skier. The Telemark turn can be used by cross-country skiers who encounter a downhill slope to be traversed.

More recently, back-country skiing has become popular. Back-country skiers search for back-country ski opportunities including considerable sized downhill slopes. Although cross-country/touring skis are adequate for traversing some downhill areas, attributes of alpine skiing equipment are still preferred by many back-country skiers.

The Telemark ski binding can be considered either a hybrid alpine ski binding or hybrid cross-country binding. More specifically, the typical Telemark ski binding affords the skier greater rigidity with respect to the connection between the boot and the ski as compared to cross-country ski equipment, but the Telemark ski binding allows for some rotational movement of the boot heel. The Telemark binding is a versatile binding that allows the skier to experience freedom both at traditional alpine skiing resorts and in open back-country skiing.

There are a number of prior art inventions directed to ski bindings, some of which are directed to Telemark type skiing equipment. Some examples of ski bindings especially adapted for Telemark skiing include the U.S. Pat. Nos. 6,685,213; 6,623,027; 6,409,204; 6,322,095; 6,299,193; 6,105,994; and 6,092,830.

While the inventions disclosed in these references may be adequate for their intended purposes, there is still a need for a releasable Telemark binding for particular types of Telemark bindings that do not have a designed release feature.

Genuine Guide Gear (G3)™ is a popular commercial Telemark binding. One style of the G3 binding includes two riser or spacer plates mounted to the ski. The riser plates act as a shim or separator which facilitates turning of a ski more easily since the boot is maintained at an elevated position with respect to the ski.

In many circumstances, it is desirable to have a Telemark binding with a specially designed release feature that allows the boot to separate from the ski based upon predetermined forces placed on the binding. Particularly in back-country skiing where there is an avalanche danger, a skier caught in an avalanche without releasable bindings creates a hazard. The ski remaining attached to the boot after the skier is buried in the avalanche results in the ski acting as an anchor preventing the skier from moving, and potentially being freed from the snow. During an avalanche when the snow is in motion, assuming the skier is conscious, the skier freed from his/her skis can perform a "swimming" motion that helps the skier to remain near the surface of the snow. Survivability is enhanced if the skier can make efforts to remain near the surface of the snow.

Releasable bindings in alpine skiing equipment are well known. Although some Telemark skiing is conducted on relatively flat terrain, downhill skiing conducted with Telemark ski equipment favors the use of a releasable binding for safety purposes.

SUMMARY OF THE INVENTION

In accordance with the present invention, a ski binding is provided with a releasable riser plate assembly. The releasable riser plate assembly is especially adapted for use in Telemark ski bindings that utilize riser plates to offset the ski boot with respect to the plane of the ski.

In a preferred embodiment of the present invention, the riser plate assembly includes a base plate, a release plate, and a front and rear housing that each include a force transmitting member. The release plate is positioned over the base plate, and is held in place by the force transmitting members of the front and rear housings. A ski brake mechanism is integrated with the riser plate assembly. The toe adapter of the Telemark binding is mounted to the release plate.

The release plate separates from the base plate when a force applied from the boot is enough to overcome the retaining forces of the force transmitting members. With respect to an adequate force generated by the boot at the rear portion of the release plate and directed substantially perpendicular from the plane of the ski, the rear edge of the release plate disengages from the base plate and rear housing. With respect to adequate lateral forces generated by the boot at the front portion of the release plate, the front edge of the release plate disengages from the base plate and front housing. Separation of the release plate from the base plate separates the boot from the ski, and activates the ski brake. Lateral extensions of the ski brake that are normally co-planar with the ski are moved to a non-planar position below the lower surface of the ski causing the extensions to engage the snow, and thereby preventing the ski from sliding freely along the surface of the snow.

In the preferred embodiment, the force transmitting members of the front and rear housings each comprise an adjustable spring that provides a biasing force against a contact member such as a ball bearing. The ball bearing has a portion thereof which is exposed for engagement with the corresponding surface of the release plate. Specifically, the front edge of the release plate engages a front contact member, and the rear edge of the release plate engages a rear contact member. The housings each include an adjustment screw that allows the user to adjust the force generated by the spring which in turn regulates the retaining force for holding the release plate against the base plate. Adjustment of the amount of force desired for retaining the release plate against the housings and base plate can be chosen according to a desired standard to include the Deutsche Institut Fuer Normung (DIN), a known standard in the alpine ski industry for gauging release forces of ski bindings.

In one aspect of the present invention, it can be considered a ski binding including the releasable riser plate assembly. In another aspect of the present invention, it can be considered the releasable riser plate assembly as a subcombination. In another aspect, the invention comprises a method of providing a controlled release of a ski boot attached to a ski by means of a ski binding.

Other features and advantages of the present invention will become apparent from a review of the following detailed description, taken in conjunction with the drawings.

DETAILED DESCRIPTION

Figure 1:
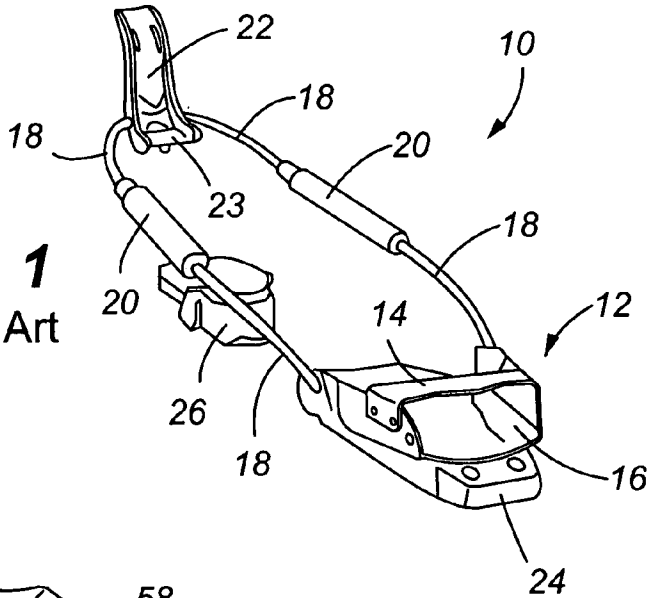
Fig. 1 Prior Art
FIG. 1 is a perspective view of a prior art Telemark binding assembly.

FIG. 1 illustrates one type of prior art Telemark binding. This particular Telemark binding generally corresponds to a model sold by Genuine Guide Gear (G3)™. This binding 10 includes a toe adapter 12 for receiving a square toe extension of the ski boot. The toe adapter 12 includes a base 16 and a latch/cover 14. The toe of the boot is secured in the opening between the latch 14 and base 16. A continuous cable 18 attaches to a rear portion of the base 16. The cable 18 has a front loop that attaches to a groove or slot (not shown) formed in the upper surface of the riser plate 24. The rear loop of the cable has a heel locking mechanism 22 secured thereto. Each lateral side of the cables 18 incorporates a compression spring cartridge 20. These spring cartridges provide for an adjustable amount of force that can be set for locking the heel locking mechanism 22 against the heel of the ski boot. More specifically, the heel locking mechanism has a lower lip 23 that engages a groove formed on the heel of the ski boot, and the heel locking mechanism is rotated upwardly to secure the binding to the boot. The heel locking mechanism acts as an over-center cam thereby locking the cable against the heel of the boot.

A Telemark binding of the type illustrated in FIG. 1 typically requires a toe riser plate 24 and heel riser plate 26 to provide some elevation of the boot with respect to the upper surface of the ski. This offset provided by the plates 24 and 26 enhances the ability for a skier to turn. In the prior art device shown in FIG. 1, the toe riser plate 24 is permanently attached to the base 16, and the toe riser plate is directly mounted to the upper surface of the ski.

Figure 2:
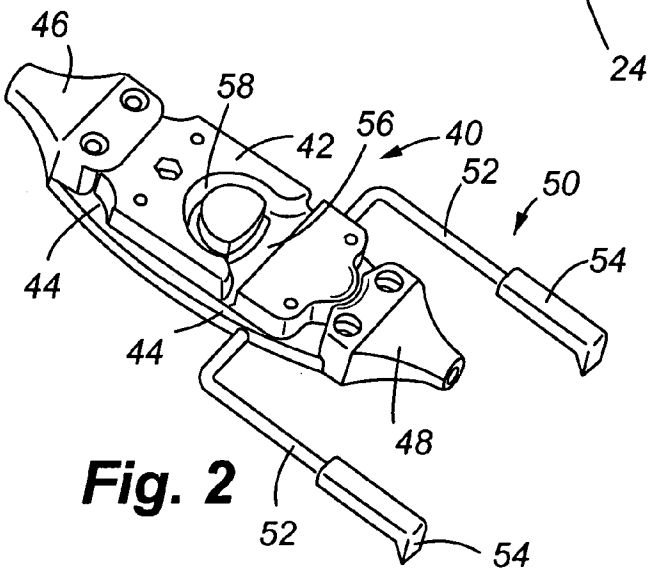
FIG. 2 is a perspective view of the releasable riser plate assembly of the present invention.
Figure 3:
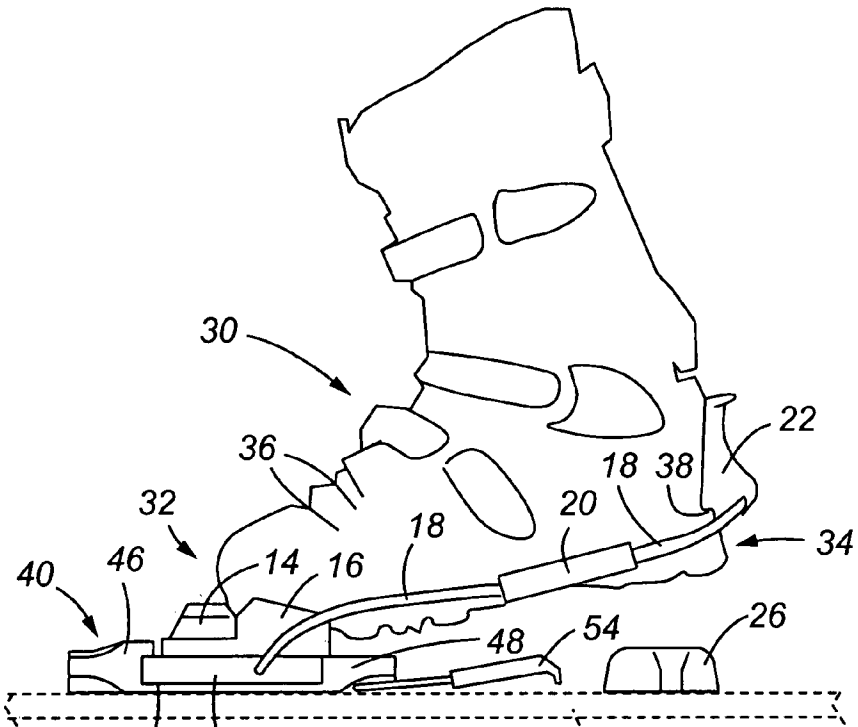
FIG. 3 is an elevation view of the riser plate assembly of the present invention installed for use with a Telemark binding assembly.

Referring to FIGS. 2 and 3, the riser plate assembly 40 of the present invention is illustrated. The assembly 40 includes a release plate 42 mounted over a base plate 44, a rear housing 48 integral with a rear portion of the base plate, and a front housing 46 integral with a front portion of the base plate. A ski brake 50 is secured to the riser plate assembly, and when the release plate separates from the base plate, the ski brake is activated to place the contact hooks 54 in contact with the surface of the snow, thereby braking the ski.

The toe riser plate 24 of the prior art is replaced with the riser plate assembly 40 of the present invention. The remaining parts of the Telemark binding are still used. Accordingly, the base 16 of the toe adapter 12 is mounted over and attached to the release plate 42, as discussed in more detail below. FIG. 3 also shows a typical hard shell Telemark ski boot. Such a boot 30 includes a toe 32 with a square shaped extension (not shown) which is received in the gap between the latch 14 and base 16. The Telemark boot may also feature a plurality of bellows 36 which allow limited flex at the balls of the feet, allowing the heel to rise away from contact with the heel riser plate 26. The heel 34 includes the groove 38 especially adapted for receiving the lip 23 of the heel locking mechanism 22.

Figure 4:
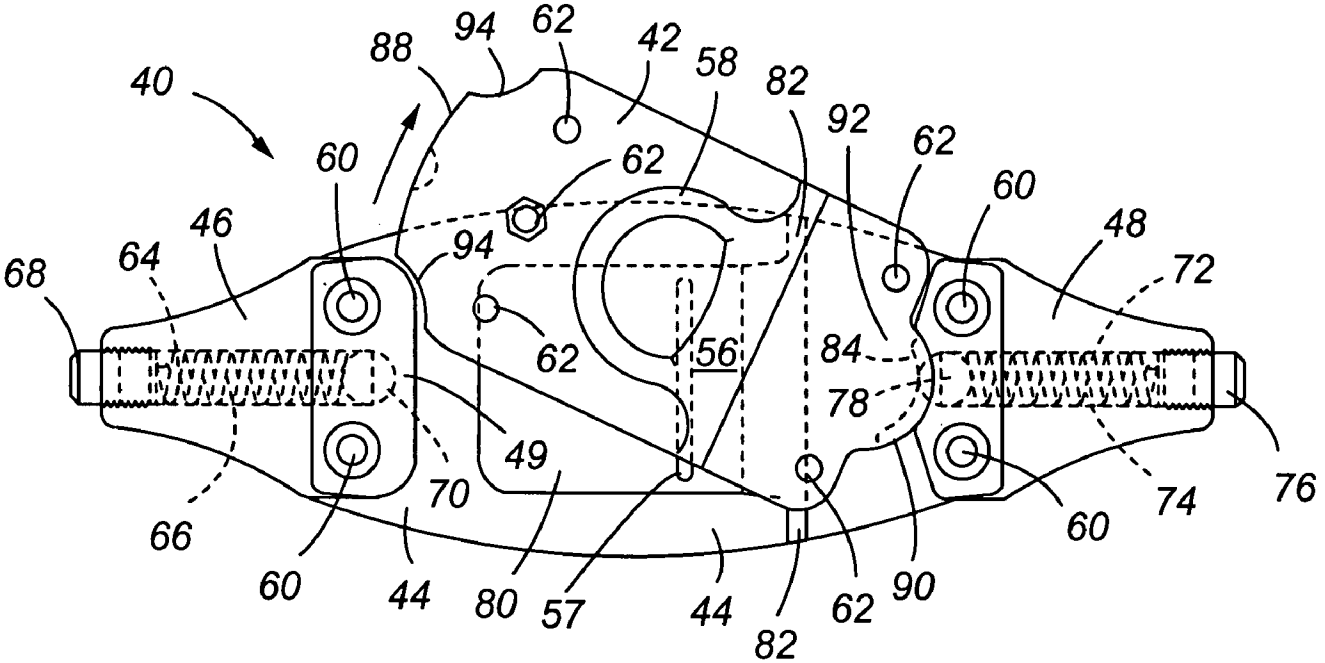
FIG. 4 is an enlarged plan view of the riser plate assembly illustrating the release plate being disengaged from the base plate by lateral force.

Referring to FIGS. 4-7, further details of the riser plate assembly are illustrated. FIG. 4 specifically illustrates disengagement of the release plate when a lateral force is exerted that overcomes the retention forces exerted on the release plate by the force transmitting members. Beginning first with a description of the features on the release plate 42, the release plate in the preferred embodiment includes a plurality of mounting holes 62 which allow the release plate to be secured to the lower surface of the base 16 of the toe adapter 12. Conventional screws or bolts may be used for securing the release plate to the base 16. The front edge 88 of the release plate includes a pair of notches 94. The rear edge 90 of the release plate includes a rounded protrusion 92. As also shown in FIGS. 4-7, the release plate includes a lateral channel 56 and a rounded shaped channel 58. The front loop of the cable 18 is received in either the channel 56 or 58, depending upon the desired length of the cable. Thus, choice of channels 56 or 58 simply provides a coarse adjustment for the tension of the cable 18.

The base plate 44 is substantially flat and extends between the front housing 46 and rear housing 48. The central portion of the base plate 44 has a depression 80 formed therein to receive the ski brake 50, as further discussed below. The front and rear housings each incorporate a force transmitting member. In the preferred embodiment, the force transmitting members are ball detent arrangements wherein a front force transmitting member 70 engages the front edge 88, and a rear force transmitting member 78 engages the rear edge 90. Holes 60 in the front and rear housings allow the housings and base plate to be secured to the upper surface of the ski 28.

Figure 8:
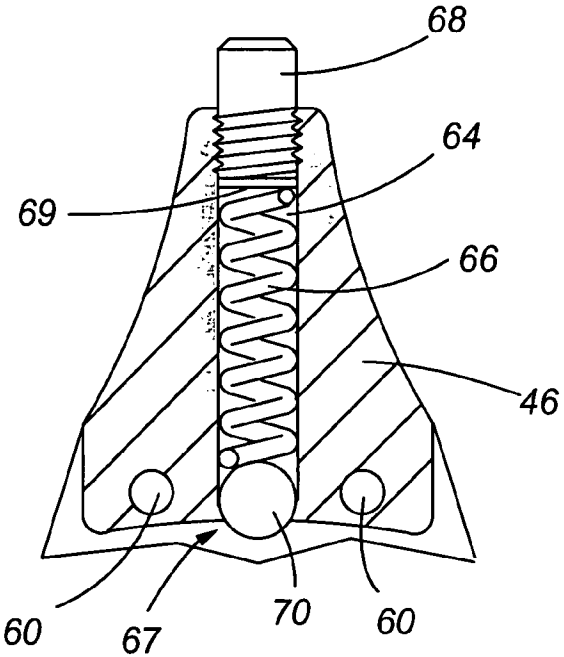
FIG. 8 is a greatly enlarged fragmentary cross-sectional plan view illustrating details of one of the assembly housings.
Figure 13:
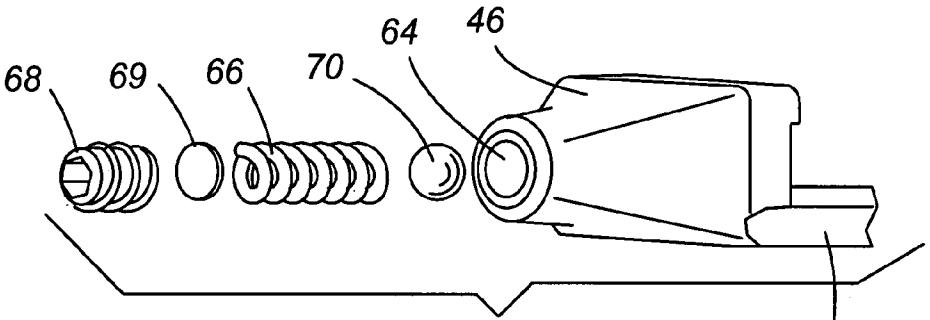
FIG. 13 is a greatly enlarged fragmentary perspective view illustrating details of the components enabling a force to be transmitted against the release plate to hold the same in position against the base plate during operation.

Referring also to FIGS. 8 and 13, a bore 64 is formed through the front housing. The bore receives the force transmitted member 70 in the form of a ball. A portion of the ball is exposed through the converging opening 67. Spring 66 is placed in the bore and in contact with the force transmitting member. The bore is closed by an adjustable screw 68. The amount of force transmitted by the force transmitting member can be selected by adjusting the screw 68. Greater travel of the screw 68 within the bore causes the spring 66 to further compress. Therefore, the amount of force required to depress the exposed part of the ball also increases as the spring force increases. The arrangement of the spring and ball can be referred to as a ball detent. The rear housing 48 adopts the same arrangement for a force transmitting member as the front housing. Thus, the rear housing also incorporates a force transmitting member 78 in the form of a ball, and a spring 74 received within a bore 72. Rear screw 76 is adjustable for varying the force of the rear force transmitting member 78.

The front edge 88 of the release plate includes a dimple or relief 86, and the front force transmitting member 70 is seated within the dimple 86 when the release plate is mounted over the base plate. The rear edge 90 of the release plate includes a channel or groove 84 formed on the rounded protrusion 92. The rear force transmitting member 78 is seated in the groove 84.

Figure 9:
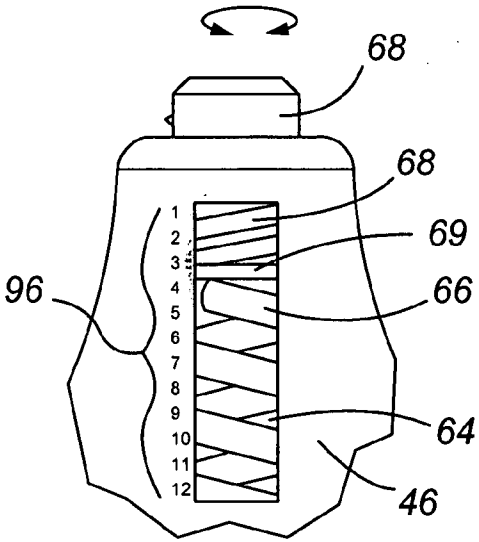
FIG. 9 is a greatly enlarged fragmentary plan view of a scale incorporated in one of the assembly housings.

Referring to FIG. 9, the front housing 46 is shown as including a DIN scale. An opening may be formed on the upper surface of the housing thus exposing the spring 66 and screw 68. A marker 69 may be placed between the free end of the screw and the spring. This indicator can be used to determine the desired compression of the spring which corresponds to a particular DIN setting. The marker 69 may be fluorescent or otherwise brightly colored so that the user can easily determine the spring setting. A transparent cover such as plastic or glass (not shown) may be used to cover the opening. The rear housing 48 may also adopt a scale 96 in the same manner as shown with respect to the front housing.

When a lateral force is transmitted from the boot through the release plate, if the lateral force transmitted is greater than the retention force transmitted by the front force transmitting member, then the release plate is allowed to laterally displace either direction, and the boot separates from the ski. FIG. 4 shows disengagement in one lateral direction, but it shall be understood that disengagement can also occur in the opposite lateral direction. The release plate 42 remains attached to the base 16 of the toe adapter 12, and assuming that the binding does not disengage from the boot, the binding remains with the boot. The base plate 44 and housings 46 and 48 remain attached to the ski. The front lip or flange 49 on front housing 46 requires that the release plate rotate a certain amount before the release plate clears the lip 49. The notches 94 can be sized to optimize clearance based on typical or average DIN settings.

In order that the release plate 42 may more freely rotate when the adequate lateral forces are supplied, the rear edge 90 includes the channel 84 which allows the rear edge 90 to rotate without undue friction with the rear force transmitting member 78. As mentioned above, the release plate may rotate out of engagement with the base plate in either lateral direction, assuming the lateral forces transmitted are great enough to overcome the retaining force of the front force transmitting member.

Figure 5:
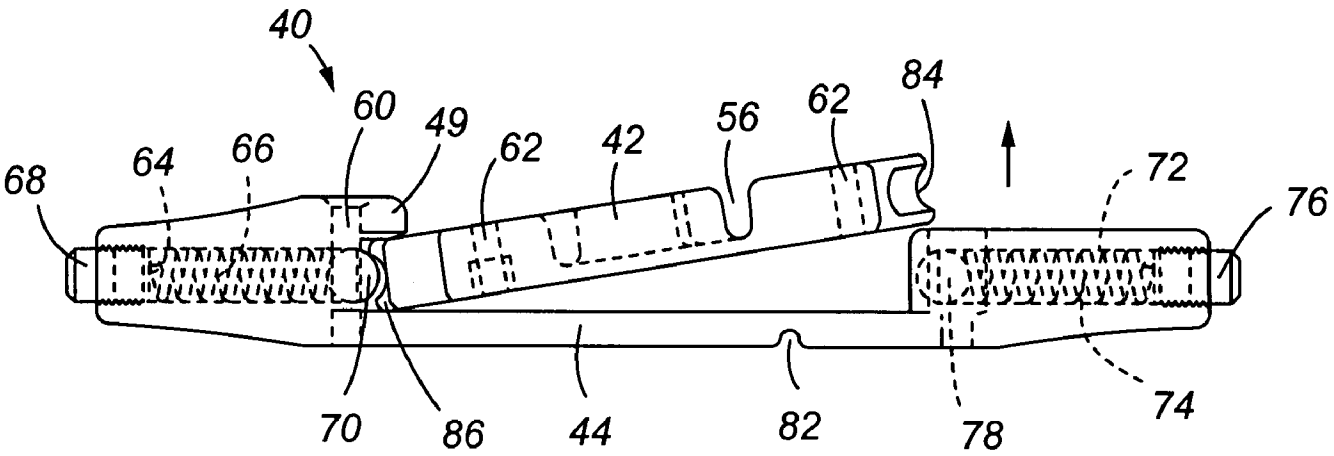
FIG. 5 is an enlarged elevation view of the riser plate assembly illustrating the release plate being disengaged from the base plate by a force directed upwards from a lane of the ski.
Figure 7:
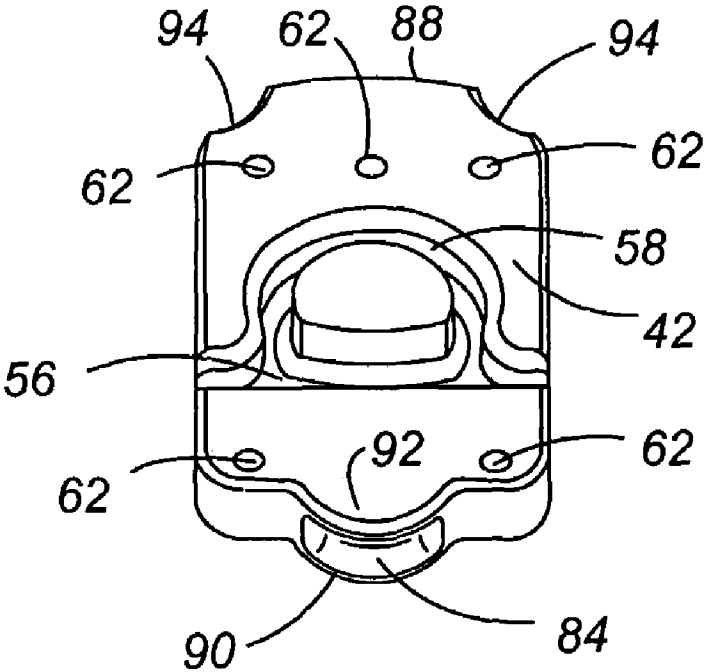
FIG. 7 is a rear perspective view of the release plate illustrating the upper surface thereof.
Figure 6:
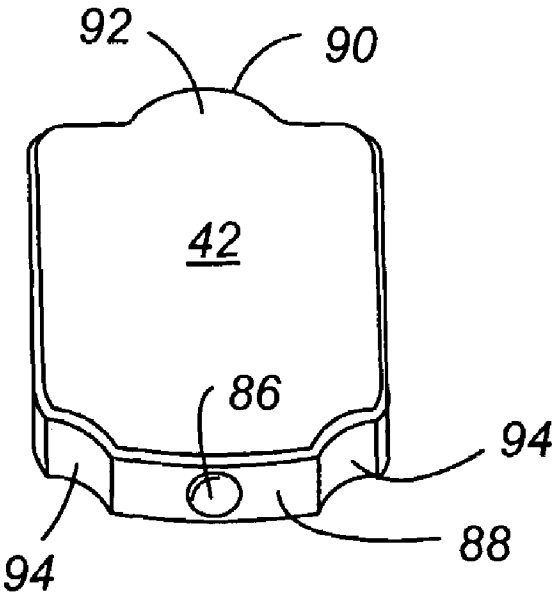
FIG. 6 is a front perspective view of the release plate illustrating the lower surface thereof.
Figure 10:
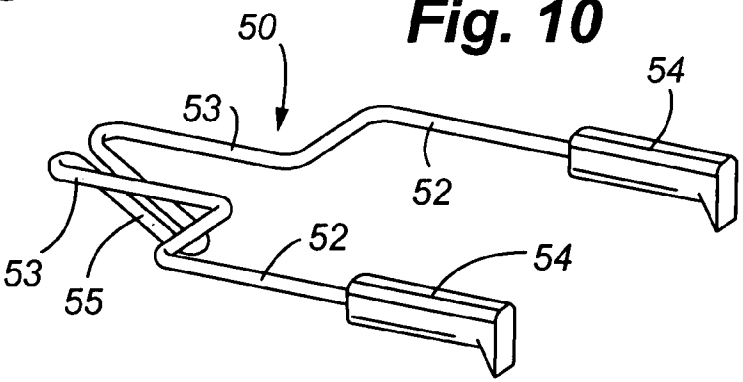
FIG. 10 is a perspective view of the ski brake.
Figure 12:
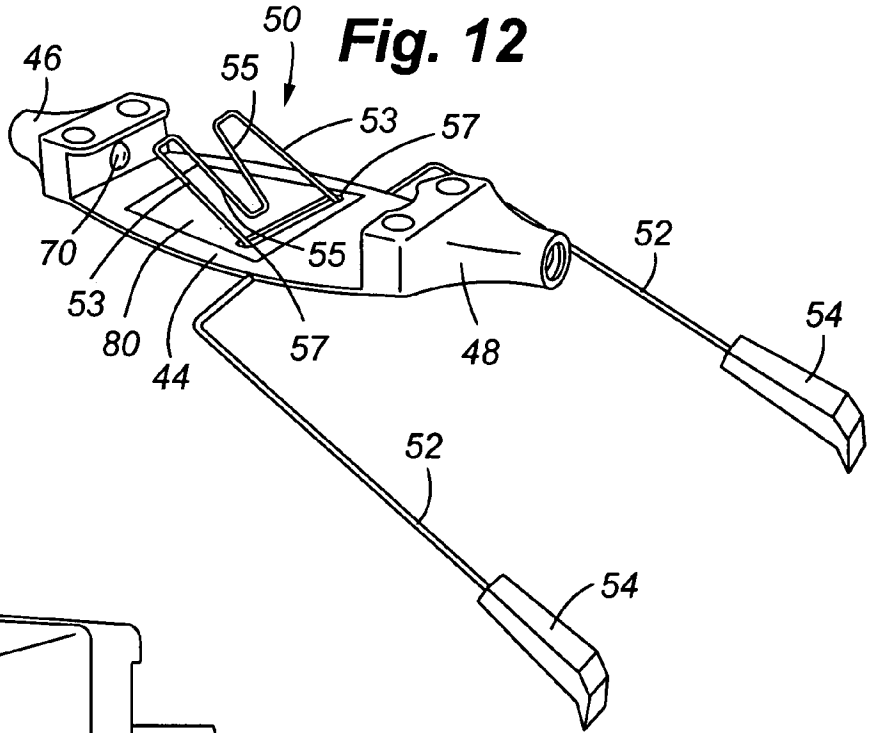
FIG. 12 is a perspective view illustrating the position of the ski brake when activated.
Figure 11:
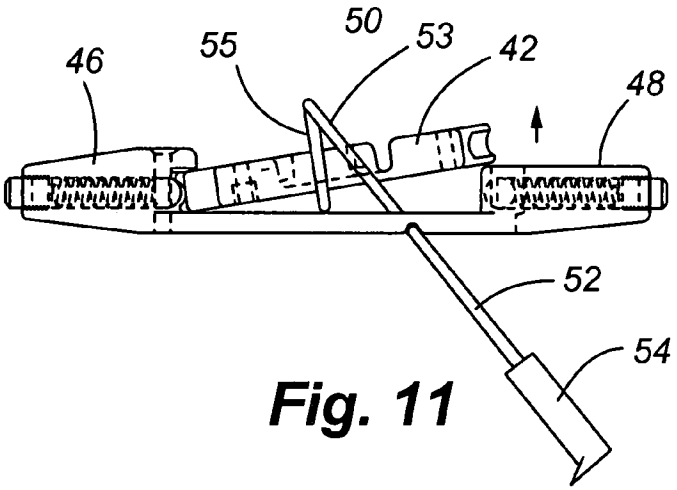
FIG. 11 is an elevation view of the riser plate assembly illustrating activation of the ski brake by disengagement of the riser plate with respect to the base plate.

As shown in FIG. 5, another way in which the release plate 42 can be disengaged from the base plate is by a force exerted from the boot in a direction substantially vertical to the plane of the ski, the plane of the ski being substantially parallel with the extension of the base plate 44. However, the vertical force which allows disengagement must be transmitted at the rear portion of the release plate, since the flange/lip 49 prevents vertical displacement of the front edge of the release plate. As well understood, it is common for a skier to lean back on the skis thereby causing an upward force to be generated at the toes of the boots. Particularly in deep powder skiing, it is advantageous to lean back in order to better control turns. However, a forward leaning position by a skier typically corresponds to a falling action, and not a skiing technique. Thus, if the skier is leaning or falling forward, then assuming the force transmitted by the boot at the rear portion of the rear plate is great enough to overcome the retention force of the rear force transmitting member, the release plate disengages from the base plate by the removal of the rear force transmitting member from within the rear groove/channel 84. The complementary shapes of the protrusion 92 of the release plate and the concave face of the rear housing 48 are also advantageous in preventing disengagement in the lateral direction. Thus, the combination of the flange/lip 49 and the concave geometry of the housing 48 with respect to the protrusion 92 allows separate force/DIN settings for each housing. Accordingly, a skier can adjust the retention forces for both vertical and horizontal axis Referring to FIGS. 10-12, details of the ski brake are illustrated. Referring first to FIG. 10, the ski brake 50 is characterized by a pair of extensions 52 which terminate with respective contact hooks 54. The forward or front portion of the ski brake includes an interconnecting part 55 that is biased with respect to the extensions 52. Front portions 53 and interconnecting member 55 are received within the depression 80 formed within the base plate 44. The extensions 52 protrude through slot 57 formed in the base plate such that the forward portions 53 and interconnecting part 55 reside on the upper surface of the base plate within the depression, while the extensions 52 extend through the bottom surface of the base plate. When the release plate is mounted over the base plate, the interconnecting part 55 and forward portions 53 are forced in a co-planar position with the extensions 52. Notches 82 are provided on both lateral edges of the base plate to receive the laterally extending portions of the extensions 52, thus enabling the extensions 52 to extend substantially planar with the lower surface of the base plate. When the release plate is disengaged, the spring force provided by the interconnecting part 55 forces the extensions 52 in a non-planar relationship with respect to the ski, that is, the extensions 52 are forced downwardly causing the contact hooks 54 to make contact with the surface of the snow. When the ski brake is activated, it remains attached to the base plate 44 since the slot 57 is only large enough to accommodate passage of the extensions 52 and not the hooks 54.

If the release plate has been disengaged thus separating the boot from the ski, the present invention provides a step-in attachment feature for reattachment of the release plate. The user simply reinserts the front edge of the release plate in the gap between the lip 49 and the upper surface of the base plate 44, and then presses the heel of the boot down so that the rear force transmitting member 78 is reseated within the groove 84.

There are a number of advantages of the present invention. Use of a releasable riser plate assembly which incorporates front and rear force transmitting members allows precise control in terms of the activation force required to separate the release plate from the base plate. The adjustment screws provide fine adjustment with respect to the amount of desired force transmitted to the front and rear edges of the release plate. In the event of release plate activation, assuming the binding still remains attached to the boot, the user puts on the ski by simply utilizing the step-in feature of the riser plate assembly. The ski brake is a simple yet reliable component that is easily incorporated within the construction of the base plate. The releasable riser plate assembly takes into consideration the two primary types of forces that should result in release of the boot with respect to the ski, namely, lateral forces, and upward or vertical forces directed from the heel of the boot. However, inadvertent activation of the release plate will not occur by upward or vertical forces directed from the toe of the boot. The force transmitting members can be generally described as ball detents which are simple yet reliable constructions.

This invention has been described in detail with reference to particular embodiments thereof, but it will be understood that various other modifications can be made within the spirit and scope of the invention as claimed.

What is claimed is:

1. A releasable riser plate assembly adapted for use in a Telemark ski binding, said riser plate assembly comprising:

a substantially planar base plate;

a front housing connected to a front end of the base plate, said front housing having a front spring mounted therein, and a front force transmitting member associated with said front spring for transmitting a force from the front spring;

a rear housing connected to a rear end of the base plate, said rear housing having a rear spring mounted therein, and a rear force transmitting member associated with said rear spring for transmitting a force from the rear spring;

a release plate mounted over the base plate;

a ski brake positioned between the base plate and said release plate; and a flange integral with said front housing, wherein a front edge of said release plate is received in a gap between said base plate and said flange, and wherein a rear edge of said release plate contacts said rear housing;

wherein, said front and rear force transmitting members each have portions thereof that are exposed through respective orifices formed in said front and rear housings; and said release plate includes a groove formed on said rear edge thereof, and said exposed portion of said rear force transmitting member being received in said groove when said release plate is mounted over said base plate.

2. An assembly, as claimed in claim 1, wherein:

said ski brake includes a pair of lateral extensions that extend beyond lateral sides of said base plate and said release plate.

3. An assembly, as claimed in claim 1, wherein:

each said force transmitting member includes a spherical shaped member.

4. An assembly, as claimed in claim 1, further including:

a front housing screw communicating with said front spring for adjusting said spring; and a rear housing screw communicating with said rear spring for adjusting said rear spring.

5. An assembly, as claimed in claim 1, wherein:

said ski brake is biased such that release of said release plate with respect to said base plate causes said ski brake to move from a first planar position to a second non-planar position.

6. An assembly, as claimed in claim 1, wherein:

said front edge of said release plate includes a pair of notches formed thereon.

7. An assembly, as claimed in claim 1, wherein:

said rear edge of said release plate includes a rounded protrusion formed thereon.

8. An assembly, as claimed in claim 1, wherein:

said rear edge of said release plate has a rounded protrusion formed thereon, and said groove being formed in said rounded protrusion.

9. An assembly, as claimed in claim 1, wherein:

said release plate is substantially planar.

10. An assembly, as claimed in claim 1, wherein:

said base plate has a depression formed therein for receiving said ski brake.

11. An assembly, as claimed in claim 1, wherein:

said ski brake includes a shaped wire member having a pair of extensions, a pair of supports, and an interconnecting part for interconnecting said pair of supports, said interconnecting part being biased with respect to said pair of supports such that said interconnecting part urges said pair of extensions to a non-planar position with respect to a plane of the riser plate assembly.

12. An assembly, as claimed in claim 1, wherein:

said release plate has a groove formed on an upper surface thereof.

13. An assembly, as claimed in claim 1, wherein:

said rear housing includes a concave contact surface, and said rear edge of said release plate has a convex shaped protrusion which is received in said concave surface when said release plate is mounted over said base plate.

14. A method of providing controlled release of a ski boot attached to a ski by means of a ski binding, said method comprising the steps of:

providing a ski binding which attaches the boot to the ski, said binding including a toe adaptor for receiving a toe of the boot, a cable extending from the adaptor and placed around the boot, and a heel locking mechanism operable with said cable to secure the binding to the boot;

providing a releasable riser plate assembly including a base plate, a release plate mounted over the base plate, and a ski brake positioned between the base plate and the release plate;

causing a force to be applied to the boot wherein the toe of the boot is forced in a direction laterally away from a longitudinal axis of the ski to which the boot is attached;

disengaging a front surface of the release plate with respect to the base plate in response to the force applied;

separating the release plate from the base plate after the release plate is disengaged from the base plate;

activating the ski brake in response to separation of the release plate from the base plate, wherein the ski brake moves from a planar position to a non-planar position wherein a portion of the ski brake extends below a lower surface of the ski; and constraining a rear edge of said release plate from movement in a lateral direction with respect to a longitudinal axis of the ski.

15. A ski binding assembly comprising:

(i) a toe adaptor for receiving a toe of a ski boot, said toe adaptor including means for capturing a toe portion of the ski boot;

(ii) a cable secured to said toe adaptor, said cable being placed around a periphery of the boot, said cable including at least one spring biased member interconnecting adjacent ends of the cable;

(iii) a heel locking mechanism secured to said cable and adapted for engaging a heel portion of the ski boot;

(iv) a riser plate assembly comprising:

(a) a substantially planar base plate;

(b) a front housing connected to a front end of the base plate, said front housing having a front spring mounted therein, and a front force transmitting member associated with said front spring for transmitting a force from the front spring;

(c) a rear housing connected to a rear end of the base plate, said rear housing having a rear spring mounted therein, and a rear force transmitting member associated with said rear spring for transmitting a force from the rear spring;

(d) a release plate mounted over the base plate, said release plate having a relief formed on a front edge thereof and a groove formed on a rear edge thereof, the front force transmitting member engaging the relief and the rear force transmitting member engaging the groove;

(e) a ski brake positioned between the base plate and said release plate; and (f) a flange integral with said front housing, wherein a front edge of said release plate is received in a gap between said base plate and said flange, and wherein a rear edge of said release plate contacts said rear housing.

16. A releasable riser plate assembly adapted for use in a Telemark ski binding, said riser plate assembly comprising:

a substantially planar base plate;

a front housing connected to a front end of the base plate, said front housing having a front spring mounted therein, and a front force transmitting member associated with said front spring for transmitting a force from the front spring;

a rear housing connected to a rear end of the base plate, said rear housing having a rear spring mounted therein, and a rear force transmitting member associated with said rear spring for transmitting a force from the rear spring;

a release plate mounted over the base plate;

a ski brake positioned between the base plate and said release plate; and a flange integral with said front housing, wherein a front edge of said release plate is received in a gap between said base plate and said flange, and wherein a rear edge of said release plate contacts said rear housing; and said front and rear force transmitting members each have portions thereof that are exposed through respective orifices formed in said front and rear housings.

* * * * *